US005349726A

United States Patent [19]

Shapiro

[11] Patent Number: 5,349,726

[45] Date of Patent: Sep. 27, 1994

[54] FASTENING CLOSURE SYSTEM

[76] Inventor: Eduardo M. Shapiro, Campos Elíseos No. 231, piso 19, Col. Polanco 11550, Mexico

[21] Appl. No.: 122,046

[22] Filed: Sep. 14, 1993

[30] Foreign Application Priority Data

Jul. 21, 1993 [MX] Mexico ..... 93 4391

[51] Int. Cl.[5] ..... A43C 7/00; A44B 21/00

[52] U.S. Cl. ..... 24/713.6; 24/712.5; 36/50.1

[58] Field of Search ..... 24/713.6, 713.9, 714.8, 24/714.6, 714.7, 714.9, 712, 712.1, 712.4, 712.5, 712.6, 712.7, 712.8, 715, 68 SK, 70 SK, 71 SK; 36/50.1

[56] References Cited

U.S. PATENT DOCUMENTS

| | | | |
|---|---|---|---|
| 494,084 | 3/1893 | Raymond | 24/713.9 |
| 711,768 | 10/1902 | Hughes | 24/712.5 |
| 811,316 | 1/1906 | McPherson | 24/713.6 |
| 2,933,831 | 4/1960 | Le Compte | 36/50.1 |
| 3,182,366 | 5/1965 | Teufel | 24/68 SK |

*Primary Examiner*—Victor N. Sakran
*Attorney, Agent, or Firm*—Ladas & Parry

[57] ABSTRACT

A fastening closure system for footwear, which is formed by a clasp securely joined to the footwear and wherein the free end of an adjustable belt is locked providing the necessary fitting in order that the footwear stays into its position on the foot of the user, comprising: a clasp having on its upper part a bracket which acts as a butt to prevent the clasp from sliding on the footwear retaining belt; a clasp head portion which enters under pressure and in a sliding manner through buttonholes located on the belt, whereby it is coupled in a cooperative manner in order to provide the fastening of the shoe; and a heel portion acting in a cooperative manner with the head and the bracket of the clasp to keep the belt fixed into its fastening positions; the clasp is provided on its lower part with two retaining pins entering into two corresponding holes made in the shoe wall and providing the necessary anchoring to the clasp in order to avoid movements of the clasp from its position; a retaining belt joined by one of its end to the shoe side where the clasp is fixed; and a clasp retainer which fastens the clasp by engagement with the clasp retaining pins to avoid the clasp being disjoined from its site by the force effected thereon by the movement of the user's foot.

5 Claims, 6 Drawing Sheets

FASTENING CLOSURE SYSTEM

SUMMARY OF THE INVENTION

This invention relates to footwear fastening clasp. Completely new in its components and way of performance, which formed by the combination of one clasp, one retainer to Keep clasp in its position on the shoe, and one belt coupling in a cooperating manner with the clasp and which operates holding and fastening any kind of footwear, shoe or slipeers.

The object of this new invention is to provide a kind of clasp completely different from the clasps existing in the market and having a unique design, which allows it to compete with other tipes of known clasps, and in many aspects to surpass them because of its practicality.

The way of manufacturing this kind of clasp is known, as well as its materials, but not its way of perfomance and it is in this last point precisely where its importance settles.

BACKGROUND OF THE INVENTION

Traditionally, most of the known kinds of shoes require fastening fixtures to keep them firmly held to the user feet. For this purposes, a great variety of retaining devices have been used such as shoelaces, cords, clasps, buckles, adhesive belts of the kind of hooklets and loops, commonly known as velcro, fastening closures, etc.

The conventional shoelaces, cords, clasps or closures currently used, include different features. The main ones are found in the type of material, strenght, performance, and security.

What distinguishes the clasps of this invention, from the others and what constitutes the invention subject of the present application, is precisely the easiness of handling and the security of its fitting, which are obtained thanks to the combination of elements, that constitute the clasp of the present invention and its disposition into the system, which permits to keep the shoe firmly secured to the foot and at the same time affords an easy handling to the user.

The novel aspect of this clasp, and which constitutes one of the features desired to be protected by mean of this document, is the utilization of three components which, integrated in a single one, give the footwear a better fastening, than that obtained with other clasps formed by a higher amount of components.

DESCRIPTION

The details and characteristical features of this novel fastening clasp are clearly shown in the following description and in the enclosed drawings, in which.

DETAILED DESCRIPTION OF THE INVENTION

With relation to the above referred figures, it can be appreciated that the closure is formed by the combination of the following three main elements.

A) Clasp (FIGS. 1, 2, 3, 4, 9, 10 and 11).

B) Clasp belt (FIGS. 5, 6, 9, 10 and 11).

C) clasp retainer (FIGS. 7, 8, 9, 10 and 11).

Figure 1:
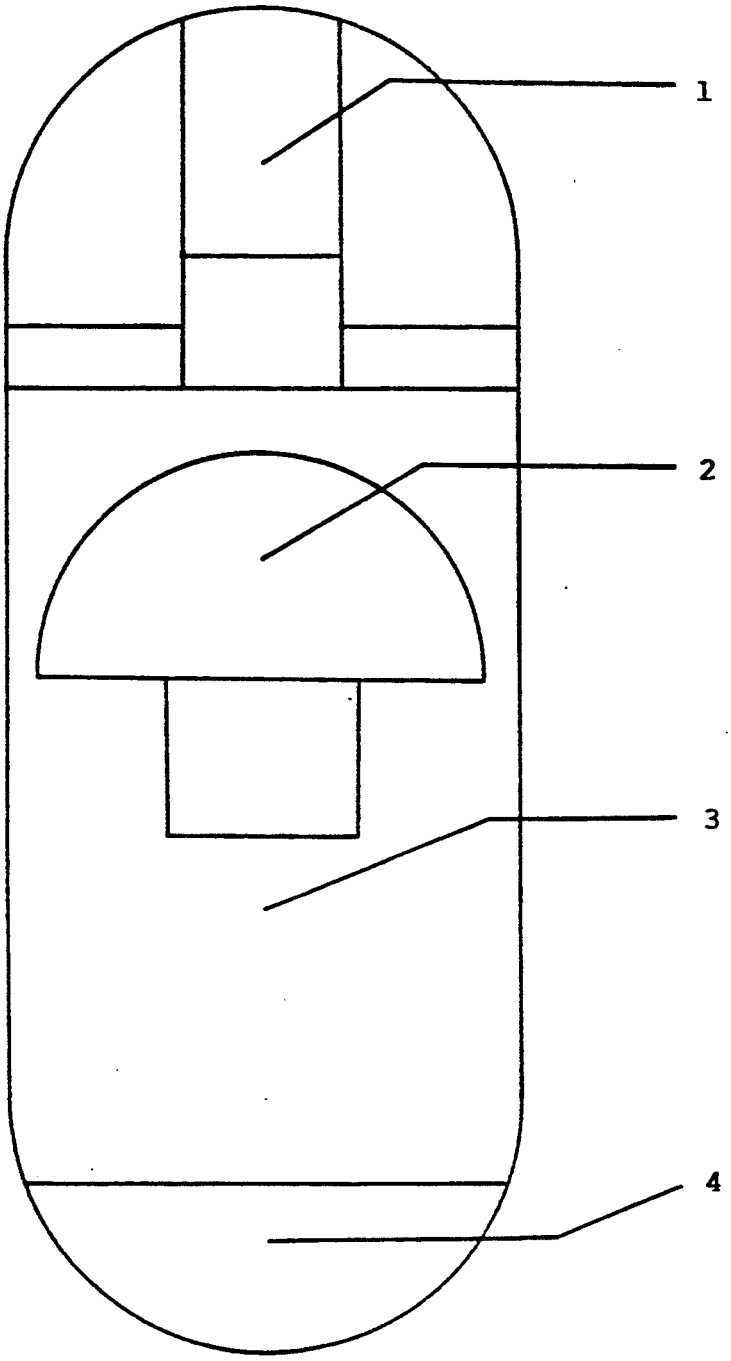
FIG. 1 is a top view of the clasp of the present invention.
Figure 2:
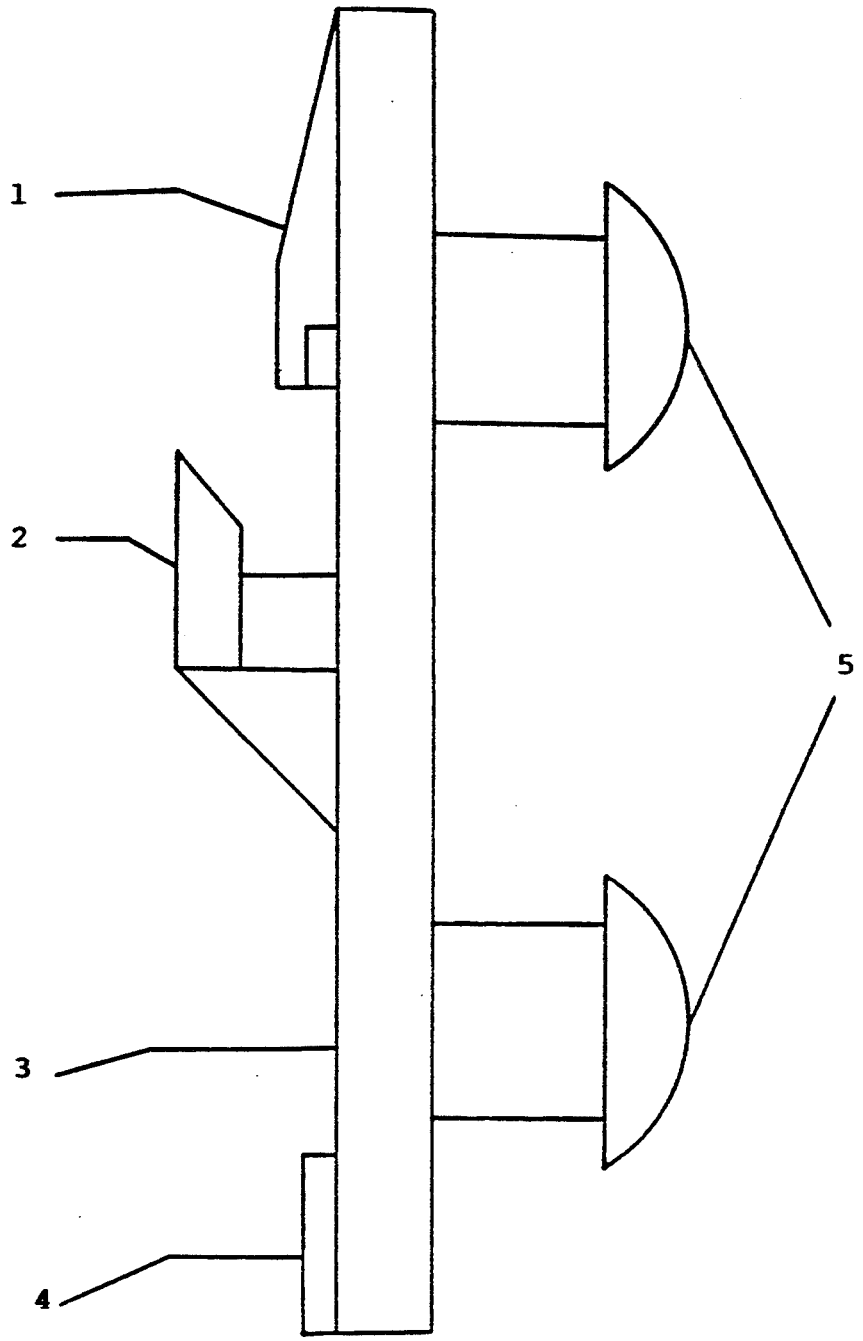
FIG. 2 is a side view of the clasp.
Figure 3:
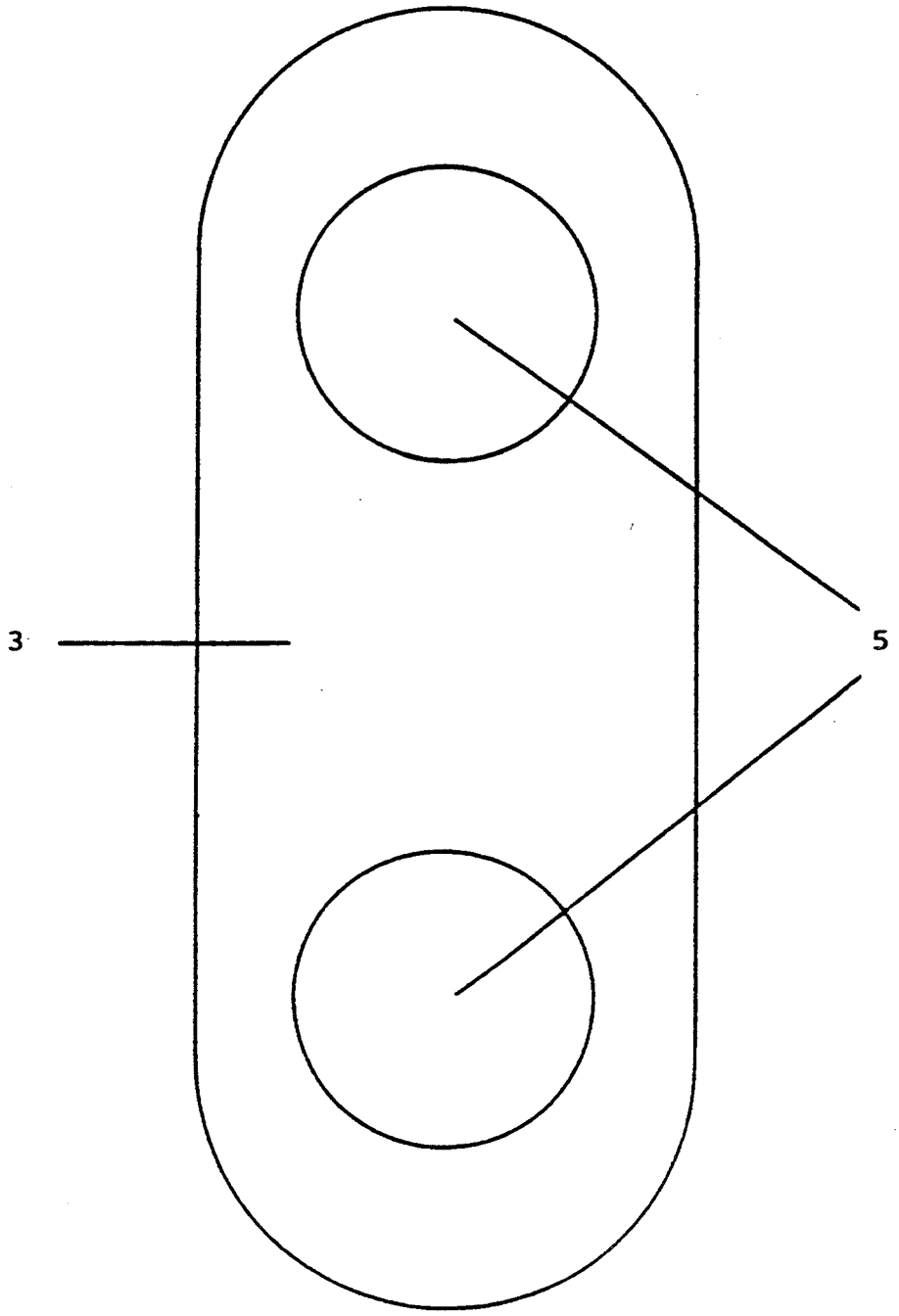
FIG. 3 is a bottom view of the clasp.
Figure 4:
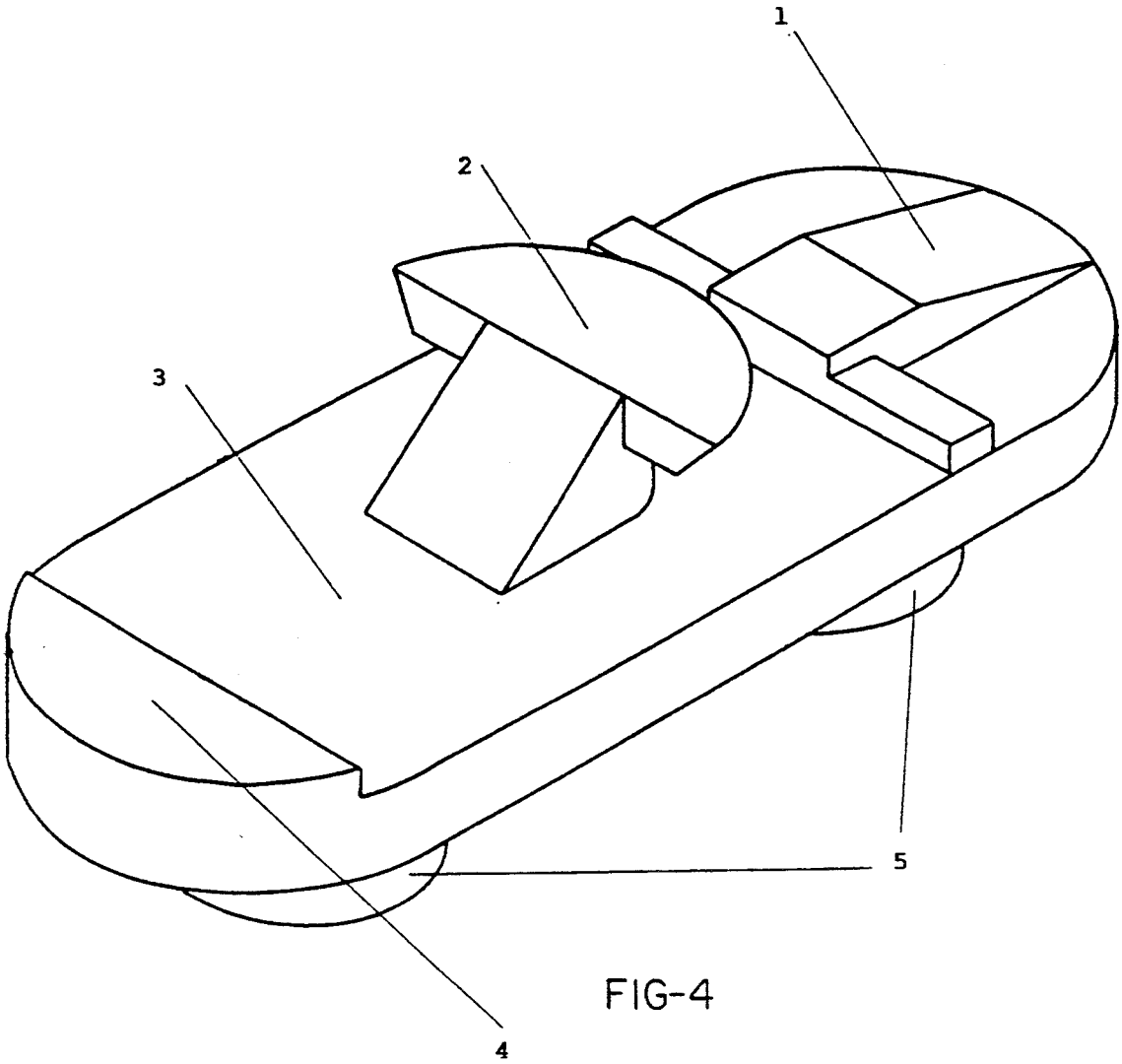
FIG. 4 is a conventional perspective view of the clasp.
Figure 5:
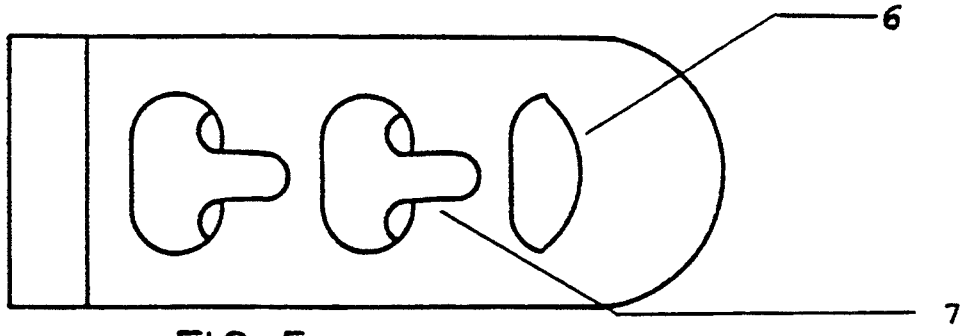
FIG. 5 is a top view of the clasp used to control the fitting of the shoe to the user's foot.
Figure 6:
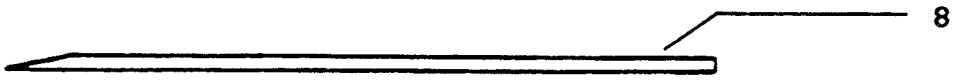
FIG. 6 is a side view of the belt.
Figure 7:
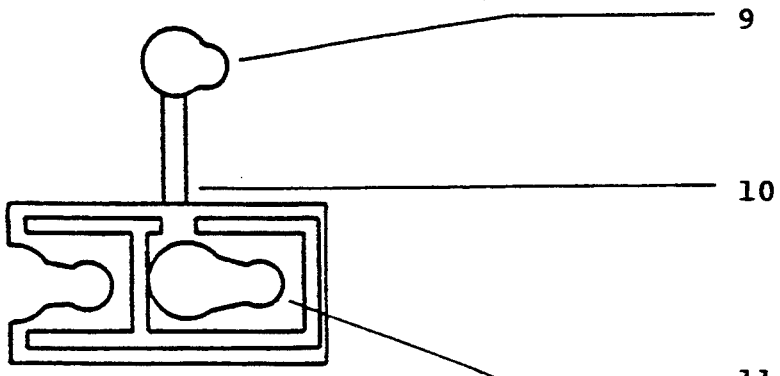
FIG. 7 is a top view of the retainer of the clasp.
Figure 8:
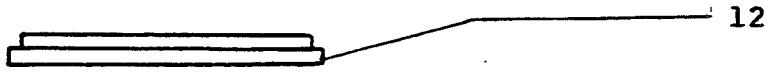
FIG. 8 is a side view of the retainer of the clasp.
Figure 9:
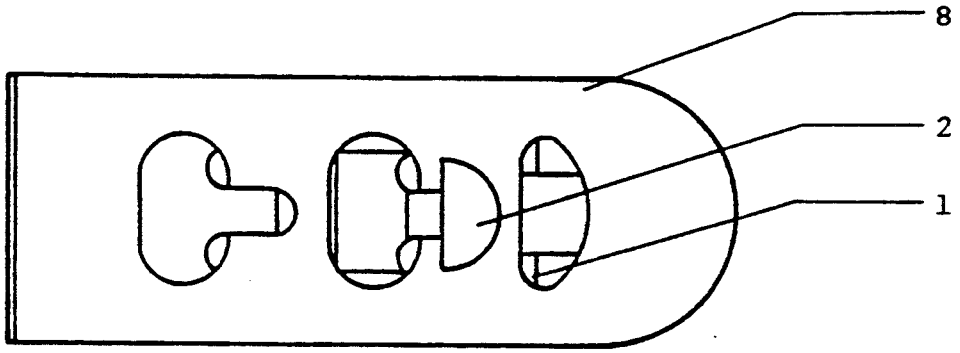
FIG. 9 is a top view of the clasp totally assembled as a whole.
Figure 10:
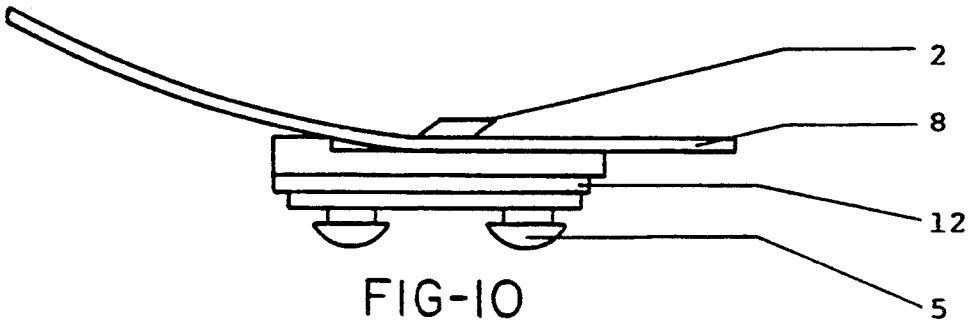
FIG. 10 is a side view of the clasp totally assembled as a whole.

The clasp (3) is formed in its upper part (FIG. 1) by a click or bracket (1) serving as a butt which prevents the clasp from sliding on the belt (8) more than required, and it works as a whole on that same side with the clasp head (2) and she clasp heel (4), fulfilling a joined function. The clasp head (2) is the more important piece, since it is the piece entering into the spacings (6) of the belt (8), under pressure and sliding thereon, and provides the addequate position to the bracket (1) and the heel (4) on the belt as shown in FIGS. 9 and 10.

By the opposite or lower part of the same clasp (FIG. 3) we find two fastening elements or pins (5), which are of the mushroom head kind (5). These mushroom head pins fulfill an Important function, since they join the clasp with the material or footwear cut-off (FIGS. 7, 8 and 11), and then enter into the spacings of the retainer and give the piece a permanent feature, maintaining fixed these three elements (clasp, cutoff or material and retainer).

The belt (8) (FIGS. 5 and 6) counts with a series of intermediate spacings (6 and 7) in which the clasp heel (4) and the bracket thereof (1) are accomodated.

Also, the belt has a series of holes through wich the clasp head penetrates to provide a security attachment.

It must be noted that this piece has a direct contact with the upper part of the clasp (FIG. 1) wherein the above referred parts are located.

In a preferred embodiment of the invention the belt has integrated plastic material layer, in which the holes are located. Said plastic material layer is joined to the belt by mean of a sewing or similar means.

The belt (8) has such a flexibility that allows it to be easily removed from the clasp, and further permits the clasp pieces (1, 2 and 4) to readily slide when coupled or uncoupled from the belt.

The clasp retainer (12), is the piece which prevents the clasp (3) to become uncoupled moved or broken by the movement of the belt (8) and by the force applied over all the closure in its whole. The clasp retainer (12) has the form of a rectangular grid and counts with two spacings (11), on which the mushroom head pins (5) of the clasp (FIG. 5) are accomodated, by means of a slight pressure exerted over them.

In addition to its strenght and security in that position, the clasp retainer (12) also counts with a lock (9) in the form a small protrusion radially extending outward the clasp retainer and which avoids any movement which could, at any moment to uncouple the retainer. This lock (9), works with the same principle as the belt (FIGS. 5 and 6) on the upper part of the clasp (FIG. 1), in other words, by pressing and sliding.

Figure 11:
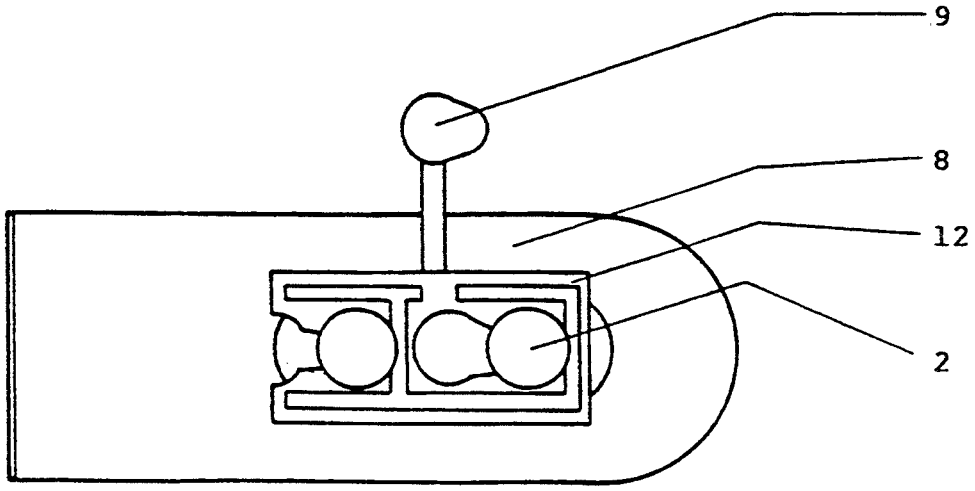
FIG. 11 is a bottom view of the clasp assembled as a whole.

The form in which this three elements are accomodated is indicated in FIGS. 9, 10 and 11, wherein the clasp head (2) is shown entering into one of the holes (7) of the belt (8) in a sliding form and under pressure, in such a manner that it stays firmly held.

The clasp (3) is located into position on the shoe by inserting the mushroom head pins through two holes made in the part of the shoe opposite to the part where the belt (8) is fastened, thus the needed anchoring is obtained in order that the clasp (3) be kept in its position on the shoe. Once the clasp (3) has been introduced into its position, the clasp retainer (12) is placed on the tip of the mushroom head pins which projects by the back side of the piece of material forming the shoe wall, and effecting a slight pressure and a sliding movement said retainer is located into its final position in such a manner that the clasp remains perfectly retained and without the possibility of unfastening even when it is strongly pulled.

The belt (8), counts with a series of clover-shaped buttonholes (7), in which the clasp head (2) is inserted in such a manner as to firmly hold the shoe.

To fasten the shoe into its position on the user's foot, the clasp head (2) is inserted into one of the buttonholes (7) and the belt is made to firmly slide without pushing it until it abuts the butt of the buttonhole, then a "click" sound shall be produced, indicating that the clasp has remained perfectly housed into its fastening position. To unfasten the shoe, the belt end is simply upwardly pulled, whereby the uncoupling of the belt with the clasp is produced.

Having described the invention as above, it is claimed as property that contained in the following:

I claim:

1. A fastening closure system for footwear, which is formed by a clasp securely joined to the footwear and wherein the free end of an adjustable belt is locked providing the necessary fitting in order that the footwear stays into its position on the foot of the user, comprising: a clasp having on its upper part a bracket which acts as a butt to prevent the clasp from sliding on the footwear retaining belt; a clasp head portion which enters under pressure and in a sliding manner through buttonholes located on the belt, whereby it is coupled in a cooperative manner in order to provide the fastening of the shoe; and a heel portion acting in a cooperative manner with the head and the bracket of the clasp to keep the belt fixed into its fastening positions; the clasp is provided on its lower part with two retaining pins entering into two corresponding holes made in the shoe wall and providing the necessary anchoring to the clasp in order to avoid movements of the clasp from its position; a retaining belt joined by one of its end to the shoe side where the clasp is fixed; and a clasp retainer which fastens the clasp by engagement with the clasp retaining pins to avoid the clasp being disjoined from its site by the force effected thereon by the movement of the user's foot.

2. Fastening closure system for footwear according to claim 1, wherein the belt has a plurality of holes in which the clasp head fits under pressure and by sliding it to a position wherein a engagement is provided avoiding the loosing of the clasp.

3. Fastening closure system for footwear according to claim 1, wherein the belt has an integrated plastic material layer in which the buttonholes are located; the plastic material layer is joined to the belt by means af sewing.

4. Fastening closure system for footwear according to claim 1, wherein the retaining pins have the form of mushroom heads.

5. Fastening closure system for footwear according to claim 1, wherein the clasp retainer has a grid shape, in which two clovershaped holes are located, and wherein the free ends of the clasp mushroom head retaining pins enter by means of pressing and sliding.

* * * * *